United States Patent [19]

Garfinkel

[11] Patent Number: 5,013,276

[45] Date of Patent: May 7, 1991

[54] ANIMATED DOLL

[76] Inventor: Henry A. Garfinkel, 31 Dogwood Rd., Searingtown, N.Y. 11507

[21] Appl. No.: 519,761

[22] Filed: May 7, 1990

[51] Int. Cl.[5] ..... A63H 13/00

[52] U.S. Cl. ..... 446/14; 446/175; 446/354; 446/484

[58] Field of Search ..... 446/14, 358, 359, 365, 446/386, 352-355, 330, 333-336, 175, 297, 298, 303, 290, 484; 40/414, 418

[56] References Cited

U.S. PATENT DOCUMENTS

| | | | |
|---|---|---|---|
| 1,781,307 | 11/1930 | Veronda | 446/335 |
| 3,285,470 | 11/1966 | Frei et al. . | |
| 3,531,891 | 10/1970 | Goldfarb et al. | 446/485 X |
| 3,700,434 | 10/1972 | Abkowitz et al. . | |
| 3,720,107 | 3/1973 | Shepard . | |
| 3,753,700 | 8/1973 | Harrison et al. . | |
| 3,912,694 | 10/1975 | Chiappe et al. | 446/354 X |
| 4,002,954 | 1/1977 | Orlando . | |
| 4,141,176 | 2/1979 | Flicker et al. | 446/359 X |
| 4,244,140 | 1/1981 | Kim . | |
| 4,798,051 | 1/1989 | Foote . | |
| 4,824,276 | 4/1989 | Ginell . | |
| 4,841,730 | 6/1989 | McDonald . | |
| 4,930,236 | 6/1990 | Hart | 446/175 X |

*Primary Examiner*—Mickey Yu

*Attorney, Agent, or Firm*—Dennison, Meserole, Pollock & Scheiner

[57] ABSTRACT

An animated fashion doll including individually articulated arms, legs and head, each separately controlled by a separate thermal motor mounted within the doll torso and controlled from a base-mounted programmable controller which is in turn responsive to remote external stimulation.

25 Claims, 6 Drawing Sheets

FIG. 6
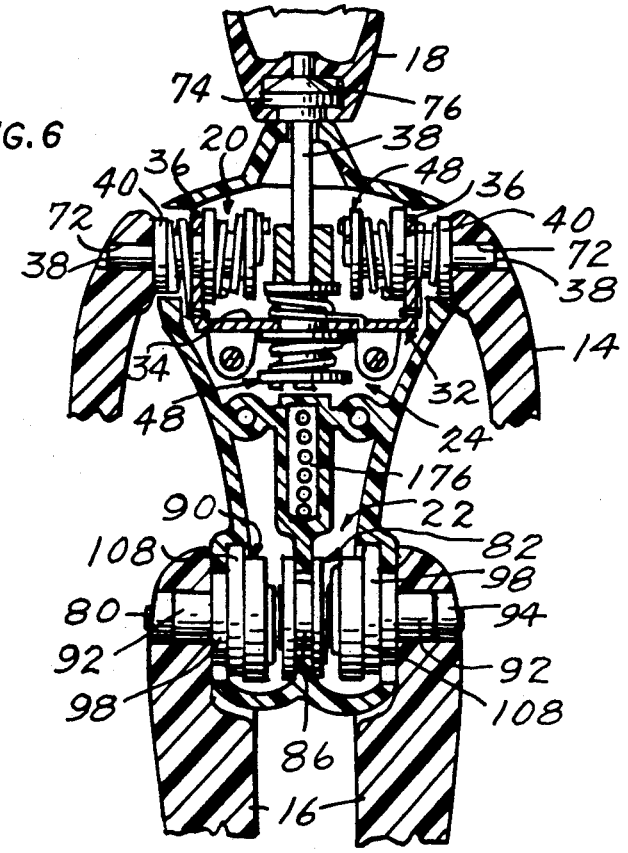
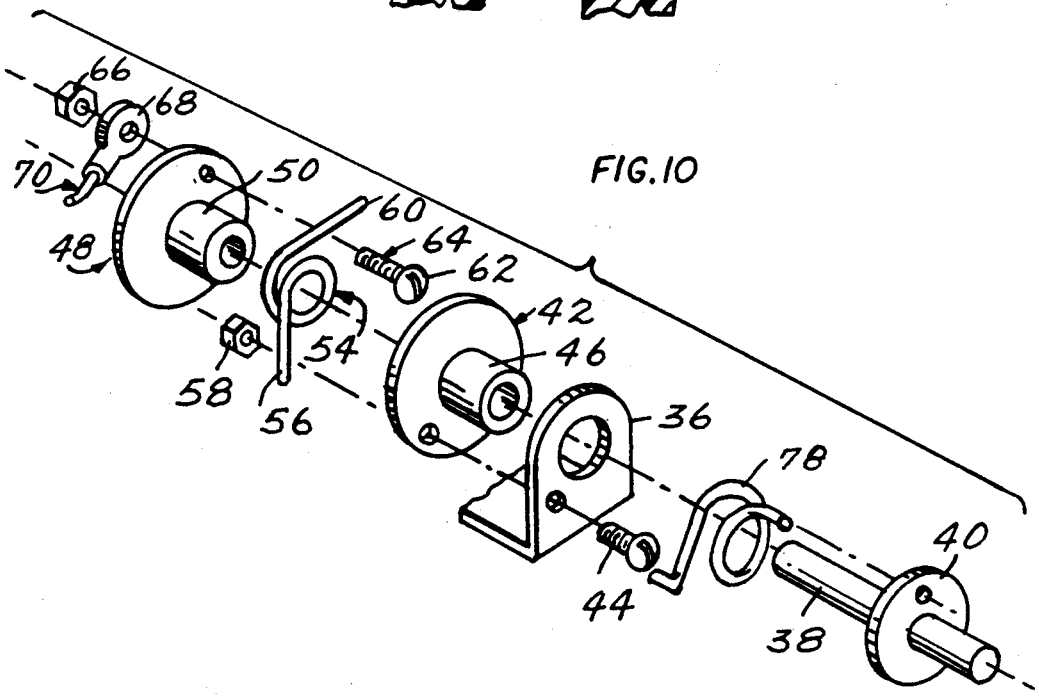
FIG. 10

ANIMATED DOLL

BACKGROUND OF THE INVENTION

The invention broadly relates to toys, and is more particularly concerned with fashion dolls of the type exemplified by the BARBIE® doll.

Such dolls are familiar to most children, particularly little girls, and have provided innumerable hours of joy with the child interacting with the doll. This interaction, in addition to the dressing of the doll in various outfits and the use of accessories therewith, has also, as an integral part of the play environment, involved a manual manipulation of the doll's limbs as a means for posing the doll, either alone or in conjunction with accessories.

While such play scenarios have been extremely successful over the years, the modern child, particularly with the advent of the computer age and everyday access to computers both in the home and in school, tends to look for a more active interrelationship with toys wherein the toy responds to external stimulation, as opposed to a more direct physical contact therewith. This is noted in various toys such as sound-activated toy vehicles, tape controlled talking dolls, and the like.

However, known forms of animation are not adaptable for use with the small 11½ inch slimly structured fashion dolls both because of space limitations and the nature of the activation which would be required for lifelike movement or simulation.

SUMMARY OF THE INVENTION

The present invention involves toy animation, and is particularly directed to the animation of fashion dolls and the like. The animation is in accord with the nature of the doll and allows for a unique interaction of the child with the doll. The animation will normally involve an automated movement of the limbs and possibly the head of the doll, with the specific nature of the movement, through programmable means, being dictated by the visual appearance of the doll, for example when dressed as a fashion doll, a cheerleader or an exercise participant.

The interaction with the child will be a natural relationship, for example, the flashing of a flashbulb to activate the fashion model, clapping or cheering to activate the cheerleader, and the blowing a whistle to begin an exercise routine. Each of the movement sequences will preferably be achievable utilizing a single doll through the use of readily interchangeable programming means and interchangeable costumes in order that the doll might be appropriately garbed for the activity involved.

To achieve the desired animation, the doll is provided with moveable or articulated appendages, specifically, arms, legs and head. Each appendage preferably has a separate actuator concealed within the doll body and associated with the appendage, for manipulation thereof, by appropriate means such as a drive shaft. The actuators are controlled by a single controller which is activated by an external stimulus, for example a noise or light, to in turn, through programmable means, activate the individual actuators in accord with the selected program to achieve appendage movement in a lifelike although controlled manner with which the child actively interact.

The actuators are electrically energized thermal motors utilizing a shape memory member such as a bimetallic or memory alloy, for example Nitinol. Electrical conductors extend from the individual actuators to a common connector accessible from the exterior of the doll, preferably at a readily concealed portion on the back of the doll. The connector releasably engages with a corresponding connector on a vertical doll-supporting stand mounted to a base which in turn contains the programmable controller. The stand, as desired, may be rotatable to provide a rotation of the entire doll as the individual appendages are manipulated. The removable nature of the doll provides an added dimension to the doll as it may be handled, dressed and otherwise played with in the manner of a conventional doll.

Energization of the several actuators may be accomplished by diverse controller means interposed between the activating external stimulus and the actuators. The controller may effect random or programmed energization. A random controller may, for example, be a solid-state chip with a random output for energization of the several actuators, this without regard to the activity the doll is garbed for. However, to enhance the play situation the several actuators are preferably energized in accord with a selected program and in this embodiment, the controller may, for example, be a solid-state chip with a programmed output or a program disk means for energization of the actuators.

The programmable controller is electrically powered, preferably by batteries, and, in a preferred embodiment, includes a series of contact brushes, one associated with each actuator. A replaceable electrically non-conductive program disk mounts between the brushes and an electrically charged contact plate with contact between the brushes and the plate being effected through apertures provided in the program disk upon relative rotation between the brushes and the program disk. The programmed contact of the brushes with the contact plate energizes the brushes. The brushes are in turn electrically connected to the stand-mounted connector for electrical energizing of the actuators in accord with the programmed contact between the brushes and the contact plate. Variations in the movement of the limbs in accord with the intended purpose of the doll are achieved by interchangeable program disks which, through the positioning of the apertures therein, provides for varying of the frequency and duration of the brush contact and the corresponding frequency and extent of movement of the appendages, for example rapid movement for "cheerleading" or "exercising" and slower, more delicate movements for "fashion modeling".

The base within which the controller is mounted has either or both optical and audio sensors which activate the controller and hence the animated doll in response to an external action taken by the child, preferably coordinated with the response to be received by the doll. For example, the doll may pose in the nature of a model in response to the flash of a camera.

Other features, objects and advantages of the invention will be noted in the following more detailed explanation of the construction, operation and manner of use of the invention.

BRIEF DESCRIPTION OF THE DRAWINGS

FIG. 6 is a vertical cross section through the torso of the doll and adjacent portions of the limbs and head;

FIG. 10 is an exploded perspective view of the components of a typical thermal motor associated with the arms and head;

DESCRIPTION OF PREFERRED EMBODIMENTS

Figure 1:
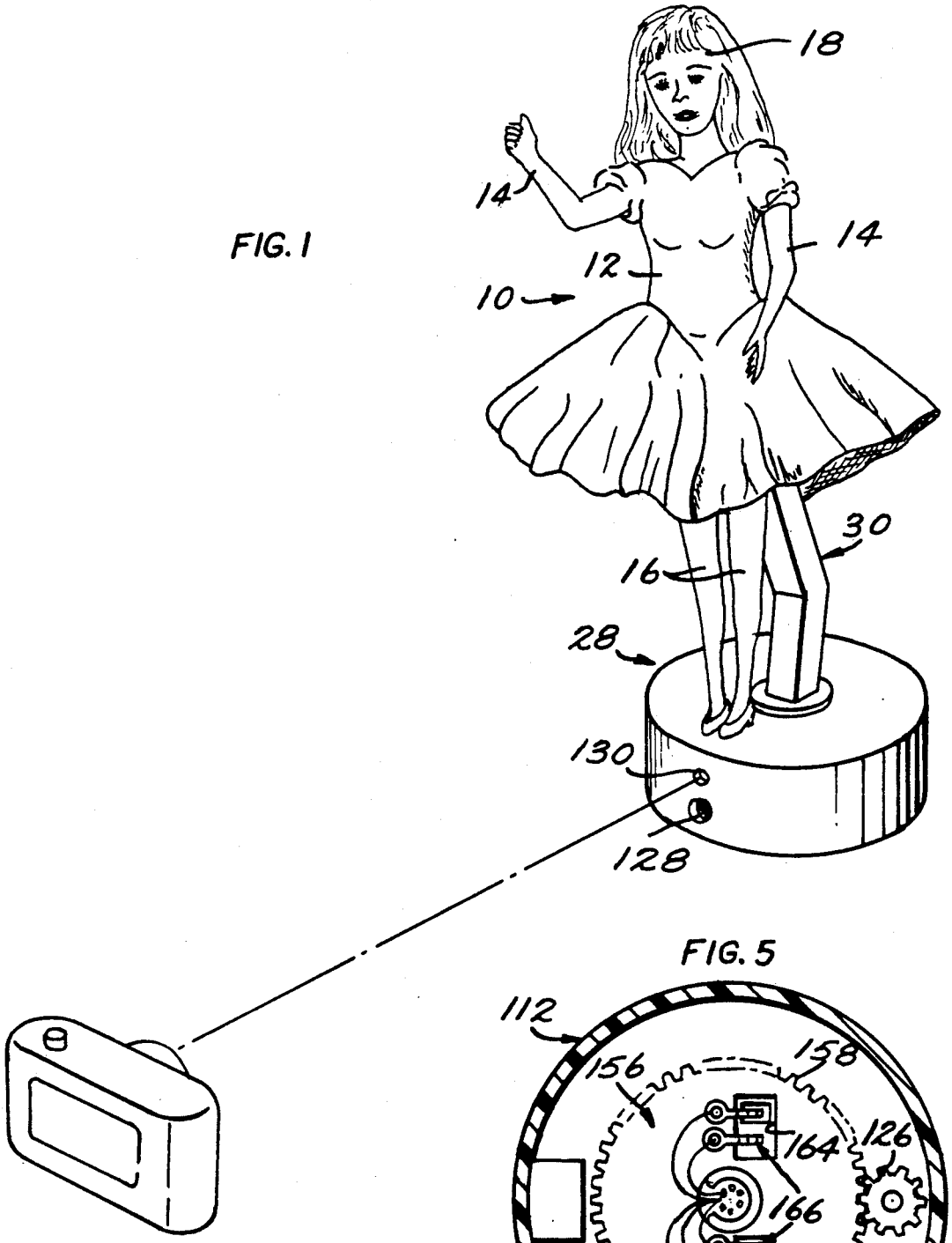
FIG. 1 is a perspective view of the stand-mounted doll with a remote triggering unit, for example a flash camera.
Figure 5:
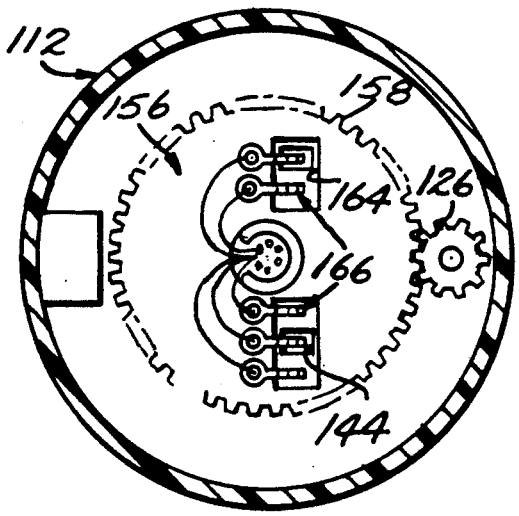
FIG. 5 is a cross section taken substantially on a plane passing along line 5—5 in FIG. 3.
Figure 2:
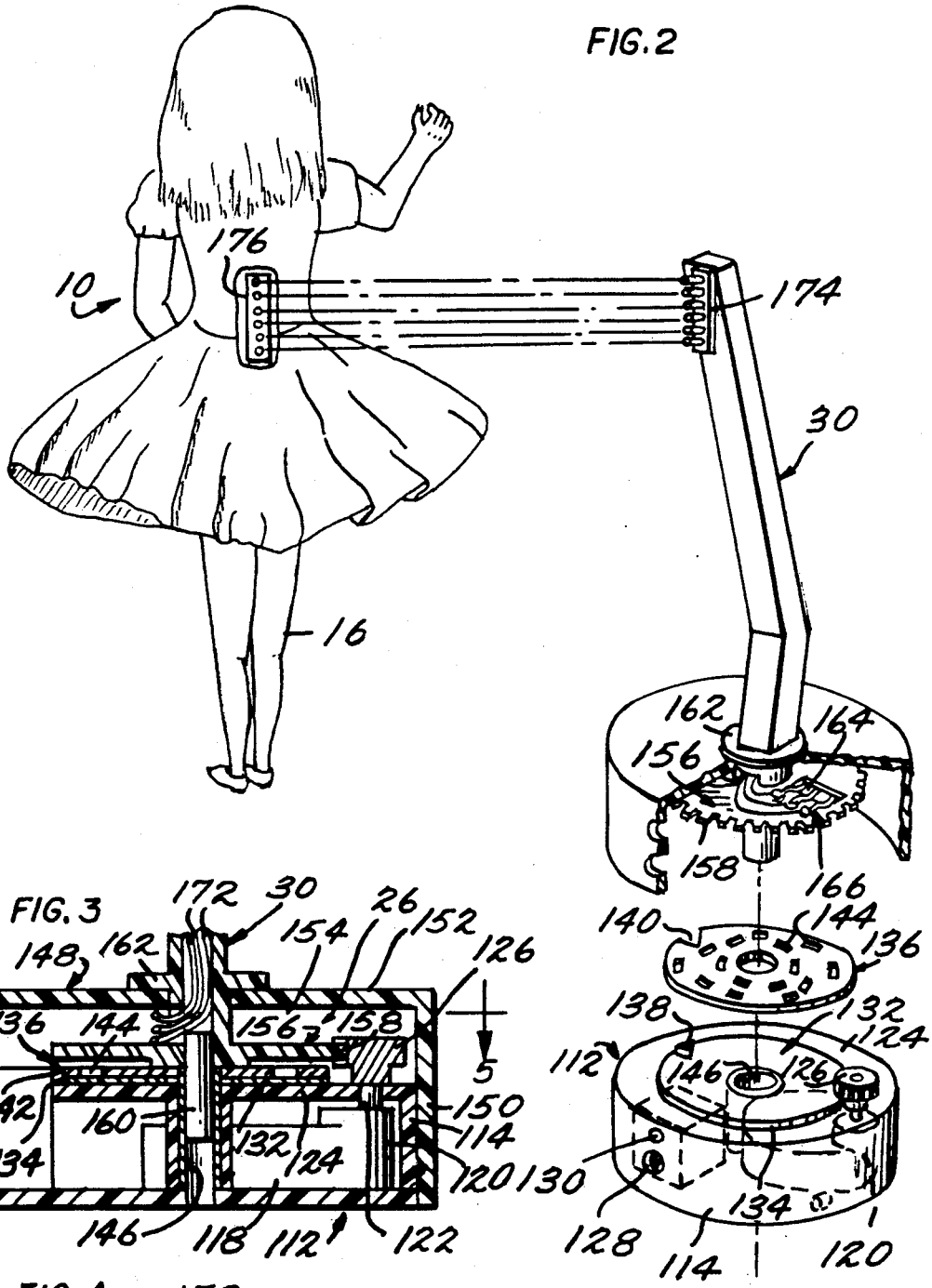
FIG. 2 is an exploded perspective view of the components of the base and stand, also illustrating the connector relationship between the stand and doll.
Figure 3:
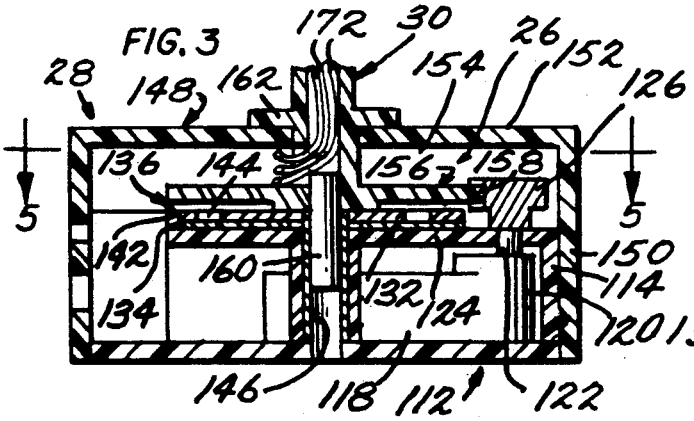
FIG. 3 is an enlarged cross sectional view through the base.
Figure 4:
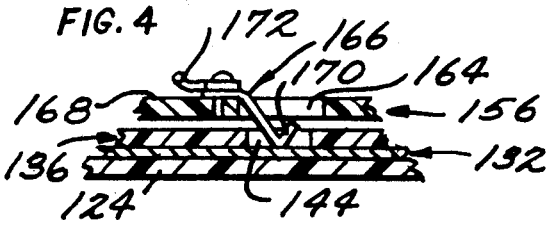
FIG. 4 is an enlarged cross sectional detail illustrating one of the circuit-completing brushes.
Figure 7:
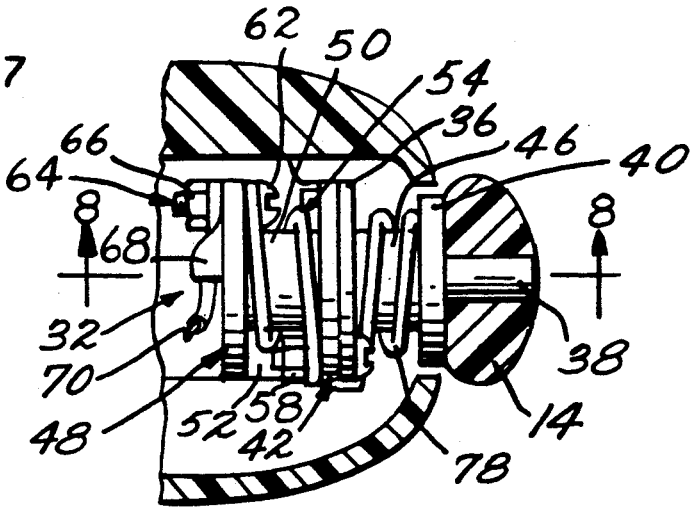
FIG. 7 is an enlarged cross sectional detail through an arm and torso joint illustrating the associated thermal motor.
Figure 8:
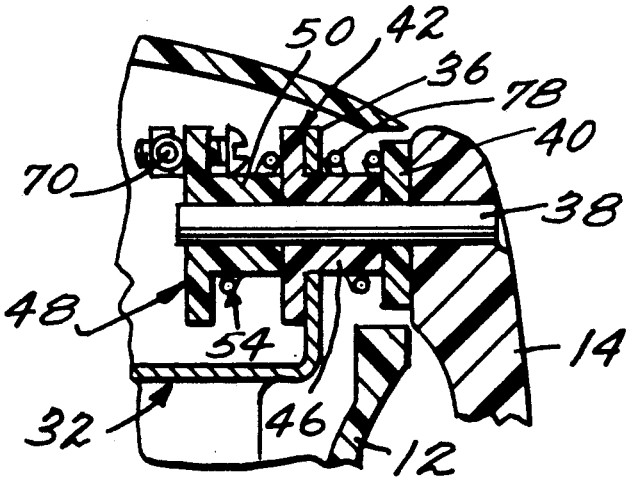
FIG. 8 is a cross sectional detail taken substantially on a plane passing along line 8—8 in FIG. 7.
Figure 9:
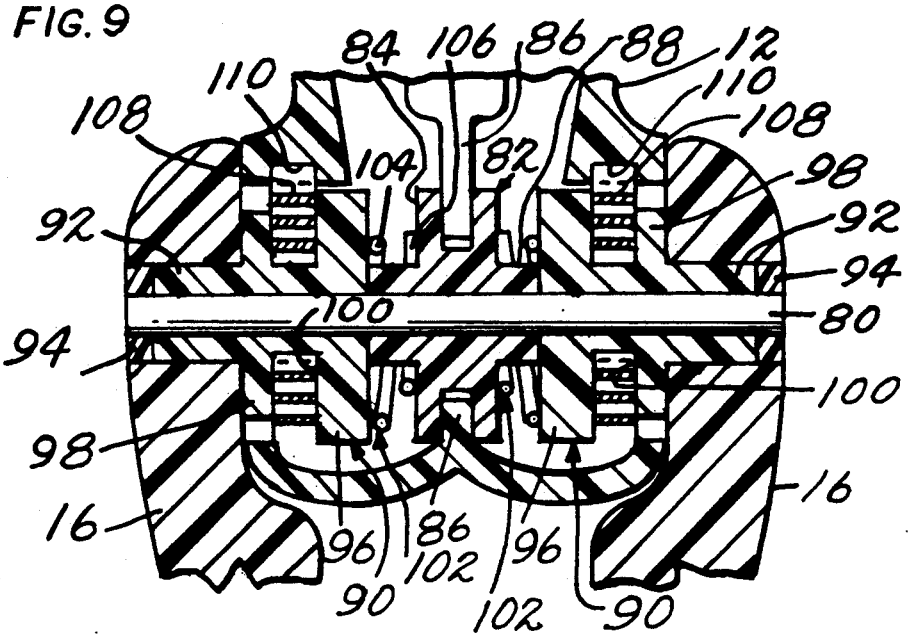
FIG. 9 is a cross sectional detail through the hip portion of the doll, illustrating the mounted legs and the thermal motors associated therewith.

Referring more specifically to the drawings, the toy is basically a doll 10, preferably an 11½ inch fashion doll, with means for animating the doll in response to external stimulation which, although not limited to, may be light, such as infrared or visible light from a flash camera, or sound from a whistle or clapping hands.

The doll 10, in the manner of a conventional doll, includes a torso 12 and appendages comprising of arms 14, legs 16 and a neck-supported head 18. In each case, the appendage is articulated to the torso by an appropriate hinge or socket which allows for rotation and/or oscillation of the appendage relative to the torso in a controlled direction or directions, normally between two opposed positions. The doll 10 as described is a self-contained toy usable by a child in a normal play environment.

The present invention proposes the animation of such a doll 10. Pursuant thereto, separate electrically energizable actuators 20, 22, 24 mount within the doll in respective driving association with appendages 14, 16 and 18. The actuators 20, 22, 24 are in turn centrally controlled by a controller 26, preferably battery powered and energizable in response to external stimulation in accord with the play scenario envisioned for the particular doll.

The controller 26 is preferably confined within a separate base 28 with a vertically extending stand 30 to which the doll is removably mounted. The stand 30, in addition to mounting the doll 10, provides for an electrical connection between the controller 26 and the actuators 20, 22, 24 for controlling flow of electricity between the controller and the actuators.

Each actuator is preferably in the nature of a miniature thermal motor mounted within the torso 12 of the doll 10 and including a shape memory element, for example a shape memory alloy such as Nitinol or a bimetallic element. Regardless of the specific shape memory element used it will be appreciated that it is the capability of the element to change shape under the influence of heat that is significant. The actual heating is generally accomplished by electrical heating means, preferably resistance heating means wherein the shape memory element or bimetallic element is in an electrical circuit of the resistance heating means.

The two arm actuators 20 and the single head actuator 24 are of the same construction and bracket-mounted within the upper portion of the torso 12, preferably on a single metal mounting bracket 32. The bracket 32, affixed by screws or other appropriate means, includes a central mounting plate or plate portion 34 with a transverse opening therethrough axially aligned with the doll head 18, and a pair of opposed end mounting plates 36, each with a transverse opening aligned with the shoulder end of one arm.

Each of the actuators 20, 24 includes an elongate shaft 38 received through the respective plate aperture. A disk 40 is received about and fixed to the shaft 38 to the outer side of the plate 34 or 36. A bearing flange 42 is bolted, by appropriate bolt means 44, in engagement with the inner side of the corresponding plate. The flange 42, considered the outer flange relative to the interior of the doll torso, includes an integral sleeve 46 extending through the plate aperture for a predetermined distance therebeyond to define a seat against which the disk 40 engages. The bearing flange 42 and sleeve 46 rotatably receive the shaft 38 axially therethrough.

A second inner flange 48, with an integral sleeve 50, is received about the shaft 38 immediately inward of the first-mentioned flange 42 with the sleeve 50 of the second flange 48 engaging the first flange 42 and defining a space 52 between the flanges 42 and 48. The second flange 48 and its sleeve 50 are locked, as by press fitting or the like, to the shaft 38.

The active member of the actuator is a thermal or thermally changeable element 54, for example, preferably a shape memory alloy such as Nitinol in the form of an elongate wire or flat twisted strip. The thermal element 54 is preferably in the nature of a coil about the flange sleeve 50, usually in a single convolution, and includes a first end 56 fixed to the outer flange 42 by the bolt means 44 which also secures flange 42 to the mounting plate. The bolt means preferably comprises an appropriate nut 58 engaged on a bolt and including a wire-trapping groove or the like therein which locks the first end 56 of the thermal element 54 against the inner surface of the flange 42.

The second end 60 of the thermal element 54 is secured to the outer surface of the inner flange beneath the head 62 of an electrically conductive metal bolt 64 extending through the flange 48. The bolt 64 is retained by an appropriate nut 66 threaded on the outer end of bolt 64 and clamping the connection lug 68 of a conductor wire 70 to the inwardly directed face of the inner flange 48. It will of course be appreciated that other means for securement and electrical connection of the ends 56 and 60 may be used.

An electrical circuit is created through the thermal element 54 with the bolt 64 providing an electrically conductive path between the conductor wire 70 and the second end 60 of the thermal element 54. The conductor wire 70 is in circuit with the positive side of the power source. The first end 56 of the thermal element 54 is, through the electrically conductive bolt means 44 and metal bracket 32, connected to a common negative.

Both ends of the thermal element or wire 54 are anchored radially outward of the shaft 38 whereby, upon a resistance heating of the thermal element 54 and a corresponding expansion thereof, the end 60 of the element 54, anchored to the flange 48, will tend to uncoil, through an expansion of the element 54 relative to the opposite end 56 thereof grounded and fixed to the mounting bracket plate 34, 36 by bolt means 44. This expansion of thermal element 54 will rotate the outer flange 48 and effect a corresponding rotation of the shaft 38 fixed thereto. Rotation of the shaft 38, through the press fitting engagement with the appendage, either an arm 14 or the head 18, will produce a corresponding movement of the appendage.

The structural relationship between the appendages and the torso 12 is such as to allow for a positive retention of the appendage while not interfering with the shaft-controlled rotation thereof. The engagement of the shafts 38 can take various forms, including a direct engagement into a bore 72 as illustrated with regard to the solid arms 14, or by means of an enlargement or mushroom 74 on the outer end of the shaft 38 frictionally engaged within a corresponding socket 76 as illustrated in regard to the head 18.

Upon a termination of the electric current effecting the resistance heating of the element 54, the element 54 cools and through the memory characteristics thereof, returns to its initial configuration, effecting a corresponding return movement of the shaft 38 and attached appendage 14, 18, thus producing an oscillation movement of the appendage in response to a selective heating and cooling of the thermal element. It will of course be appreciated that the shape memory element may be heated by other than direct electrical resistance heating by its inclusion in the programming circuit. In this regard, for example, electrical heater means acting indirectly upon the shape memory element may be used.

Preferably, in order to enhance the return of the shaft 38, and rather than relying solely on the cooling of the thermal element 54, a return spring 78 may be provided, which is in the nature of a coil spring, engaged about the sleeve 46 of the outer flange 42 between the mounting bracket plate 34, 36 and the disk 40. The opposed ends of the return spring 78 are respectively fixed to the plate 34, 36 and the disk 40 in radially outwardly spaced relation to the shaft 38. This may be done by laterally directing the ends of spring 78 and engaging one end through an aperture in the disk 40 and the other end against an edge of the corresponding plate. The spring 78, prior to activation of the actuator 20, 24, is at rest. Tension is developed in the spring 78 as the shaft 38 and disk 40 and appendage rotate through an expansion of the thermal element 54. This tension, in turn, upon a removal of the heating current from the thermal element 54, encourages a positive return of the shaft 38. It will also be appreciated that the return spring 78, by providing for an initial resistance to rotation of the shaft 38 as the thermal element 54 begins to heat, will also provide for a more positive initial movement of the shaft 38 as the energy in the element 54 builds to a point sufficient to effect a positive overcoming of the initial resistance of the return spring. The spring 78, as desired, may be a constant force spring whereby once the initial tension is overcome, the shaft and appendage will rotate at a constant rate in a life-like manner.

Referring now to the leg actuators 22, while these actuators 22 can duplicate the arm and head actuators 20 and 24, the greater weight of the appendage, that is the leg 16, makes it preferable to use an actuator capable of producing greater torque.

Each actuator 22 mounts on a shaft 80 fixed within the lower portion of the torso 12 and extending transversely thereof so as to project beyond the torso at the hip joint. While separate shafts 80 can be provided, depending upon the particular angular orientation of the hip joint, a single shaft 80, as illustrated, will normally be utilized. The single shaft 80 has the opposed end portions thereof extending into the opposed hip joints and is centrally fixed within the torso by a central mounting bracket 82. The bracket 82, as illustrated, can include a central mounting block 84 peripherally grooved for non-rotational reception within integrally formed retaining ribs 86 on the interior of the torso. The mounting bracket 82 includes opposed sleeve portions 88 extending laterally to the opposite sides of the central block 84. The central block 84 and sleeve portions 88 are received about and fixed to the shaft 80 for non-rotational support of the shaft.

Each actuator 22 includes a flanged bearing member 90 including a central sleeve or sleeve shaft 92 rotatably received about the shaft 80 and extending from the mounting bracket sleeve 88 outward to the exterior of the torso 12 and to the outer corresponding end portion of the shaft 80. The bearing member sleeve shaft 92 is retained on the corresponding end portion of the shaft 80, outward of the torso, by a retaining collar 94 fixed to the corresponding end of the shaft 80.

Each flanged bearing member 90 includes, integral with the sleeve shaft 92, inner and outer circular flanges 96 and 98 in general alignment with the outer wall of the torso 12 at the hip joint. The flanges 96 and 98 are spaced to define an annular groove or space 100 therebetween.

Each leg 16, at the upper end thereof is frictionally or otherwise non-rotatably mounted to the outer end portion of the bearing member sleeve shaft 92 for rotation therewith. As will be appreciated, the retaining collars 94 are diametrically smaller than the sleeve shafts 92 for a retention of the sleeve shafts without interference with the legs mounted thereto and rotatable therewith.

The flanged bearing member 90 of each actuator 22 comprises the drive and leg-receiving component thereof with the corresponding thermal element 102 coiled about the sleeve portion 88 of the central mounting bracket 82. The thermal element has a first end 104 bolted or otherwise secured to the inner face of the inner flange 96 and with the positive terminal of the power source. The opposite end 106 of the thermal element 102 is in turn bolted or otherwise affixed to the fixedly positioned central mounting bracket 82 and in circuit with a common negative or ground. The opposed ends 104 and 106 of the thermal element are secured eccentric to the axis of rotation of the bearing member 90 with the selective uncoiling of the thermal element 102 upon heating effecting the desired rotation of the leg appendage. A corresponding return to an at rest position is effected upon cooling of the thermal element under the influence of the shape memory thereof. Expansion and contraction of the thermal element 102 is preferably controlled by resistance heating of the thermal element as detailed in connection with the previously describe actuators 20, 24.

Each actuator 22 preferably includes a return spring 108 preferably in the form of a flat spiral ribbon spring, positioned within the space 100 between the inner and outer flanges 96 and 98 of the flanged bearing member 90. The inner end of the spring 108 will be fixed to the bearing member 90 at the inner end of the annular space, preferably to the sleeve 92. The outer end of the spring 100 will be fixed to the torso wall at the hip joint, preferably being received within a recess 110 in an enlarged portion of the torso wall for stabilization of the spring end.

The return spring 108 functions in the manner of the return springs of the actuators 20 and 24, moving from the at rest position as the thermal element expands and enhancing the return of the appendage as the thermal element cools.

The actual heating of the thermal element 54, 102 of each actuator 20, 22, 24 is normally effected through the bolt or other electrically conductive means which mounts the one end of the thermal wire to the corresponding flange which is in turn mounted for rotation with the member, either shaft 38 or sleeve shaft 92, which receives the appendage. The opposite end of the thermal element, anchored either directly or indirectly to the bracket or mount, remains stationary as the thermal element or wire expands. The expansion of the element causes an uncoiling thereof to rotate the rotatable flange and the shaft 38 or sleeve 92 to which it is affixed. The return spring assists in an oscillation return of the shaft 38 or sleeve 92 upon a removal of electrical current and as an assist to the memory of the thermal element. The return spring will also aid in effecting a smooth or lifelike movement of the appendage or limb. Gravity can also be a factor in the return of a limb, for example lowering a limb initially raised by the thermal element.

The actuators are individually controlled from the controller 26 within the base 28. In a preferred embodiment the base includes a cylindrical inner housing 112 with a depending peripheral skirt 114 defining an interior chamber housing a battery compartment 118 and a battery driven motor 120. A drive shaft 122 extends vertically from motor 120 through the circular planar top 124 of the inner housing 112 and mounts a pinion drive gear 126 radially outward from the center of the planar top 124. The inner housing also includes audio and/or infrared or visible light sensing circuitry, with an exposed audio sensor 128 and/or an exposed light sensor 130, for a selective energization of the drive motor.

The planar top or upper surface 124 of the inner housing 112 mounts a circular electrically conductive metal disk 132 axially thereon and with the periphery 134 thereof spaced immediately inward of the drive gear 126.

The metal disk 132 is overlaid by one of a series of interchangeable circular program disks 136 positioned by a positioning lug 138 projecting upwardly from the planar top 124 and engaged within a positioning notch 140 on the program disk 136. The program disk 136 is of an appropriate electrically non-conductive material with the periphery 142 thereof generally coextensive with the periphery 134 of the underlying metal disk 132 and inwardly spaced relative to the drive gear 126. The positioning lug 138 can also be used to maintain the position of the metal disk 132 against rotation.

The program disk 136 includes a separate "circular" track for each of the appendages to be controlled, in the illustrated example five concentric tracks, one each for the head, the two arms and the two legs. Each track is defined by a series of circumferentially aligned generally elongate arcuate openings or slots 144.

A central metal sleeve 146 extends axially through the program disk 140 and the metal disk 132, as well as the underlying top panel 124 of the inner housing 112. This sleeve 146, insulated from the "positive" disk 132, is mounted in circuit with the negative contacts of the power source or batteries.

A cylindrical outer or upper housing 148 telescopically overlies the inner housing 112 with the skirt 150 of the outer housing 148 encircling the skirt 114 of the inner housing 112 and with the flat top or upper panel 152 of the outer housing overlying the top 124 of the inner housing 112 in vertically spaced relation thereabove to define a chamber 154 of sufficient depth as to accommodate the disks 132, 140 and drive gear 126, as well as an overlying circular gear plate 156 with gear teeth 158 defined about the periphery thereof.

The gear plate 156 mounts on and is fixed to a depending metal stem 160 which is in rotatable conductive engagement within the central sleeve 146. The stem 160 is in turn rigid with the vertical stand 30 which projects centrally upward from the top panel 152 of the outer housing 148 and is rotatably extended therethrough. An appropriate panel-overlying flange 162 may be incorporated into the stand 30 to positionally retain the stand 30 relative to the top panel 152.

The outer housing 148, when engaged over the inner housing 112, will be releasably locked thereto by appropriate latch means to preclude removal and/or rotation of the outer housing 148.

The stand 30 is hollow and receives separate conductors therethrough for each actuator. The gear plate 156, along with the stem 160 and the stand 30 fixed thereto, rotates through driving engagement of the drive gear 126 with the toothed periphery 158 of the gear plate 156.

The gear plate 156 is of electrically non-conductive material and includes one or more apertures 164 therethrough, which, either alone or in combination, overlie each of the tracks in the program disk 136. A series of spring-like metallic brushes 166 are fixed at one end to the upper surface 168 of the gear plate 156, one in alignment with each track, and extend to laterally directed free, contact end portions 170 which depend through one of the gear plate apertures 164 for sliding support along the upper surface of the program disk 136. Selective spring-loaded projection of the free end portions 170 through the program disk 136 into contact with the underlying metal disk 132, which is in turn in circuit with the positive terminals of the source of electricity, occurs upon alignment of the program disk slots 144 with the free end portions 170. A series of conductors 172, in the nature of wires, attach to the brushes 166 and extend individually through the stand 30 to a connector 174 at the upper end of the stand 30 and therethrough to a mating connector 176 on the doll 10. The mating connector 176, through the conductors 70 completes the circuit to the individual actuators with one actuator associated with each program disk track.

In operation, the drive gear rotation of the gear disk or plate 156, with the brushes 166 thereon and carried thereby, brings the brush associated with each track sequentially over the program disk slots 144, the brush 166 moving into each slot 144 and contacting the electrically conductive plate or disk 132 therebelow. Contact with the plate 132 completes the circuit and results in a corresponding resistance heating of the thermal element 54, 102 in the associated actuator. The contact is broken as the brush 166, through the continued rotation of the gear plate 156, is cammed up out of contact with plate 132 as the brush 166 passes beyond the slot 144. The length of each slot 144 and the frequency of the slots 144 in conjunction with the spacings therebetween control the movement of the appendage.

The movements of the appendages are thus independent of each other and can vary in frequency, rapidity and actual length or distance travelled. That is, the arms can have rapid relatively short movements as by a cheerleader waving pom poms. Slower movements of greater extension can simulate modeling. Movement of the arms to extreme positions can simulate aerobic exercising. The legs will also be similarly controlled with the head moving in a manner to coordinate with leg and arm movements. The wide variety of movements are readily achievable by the use of replaceable program disks wherein the number and circumferential extent of the slots are varied.

As a variation, the replaceable program disk 136 can be driven simultaneously with the gear plate 156 at a different rate of rotation utilizing a compound drive gear. In doing so, each of the replaceable program disks can be provided with a toothed periphery or alternatively, the program disks can be secured to the underlying metal plate 132 which will in turn be provided with a toothed periphery. With the dual driving, the rotation of the stand fixed to the gear plate 156 is not limited to duplicating rotation of the program disk. For example the stand can rotate twice before the entire program disk has been read. As a further variation, the stand can be fixed to the outer housing with the gear plate rotation relative thereto for activation of the doll appendages without rotation of the doll.

Figure 11:
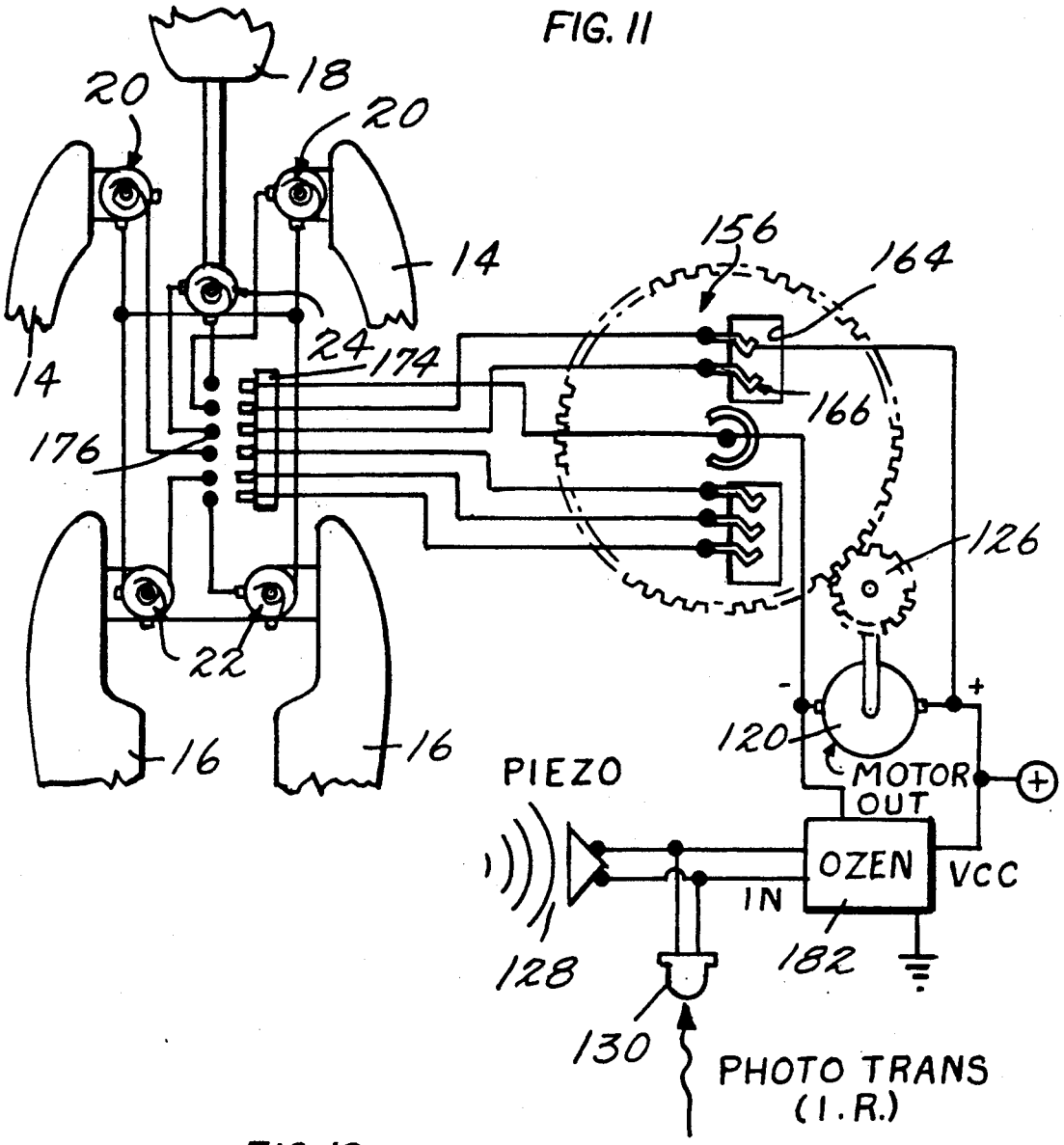
FIG. 11 is a schematic circuit diagram wherein program disks are utilized.
Figure 12:
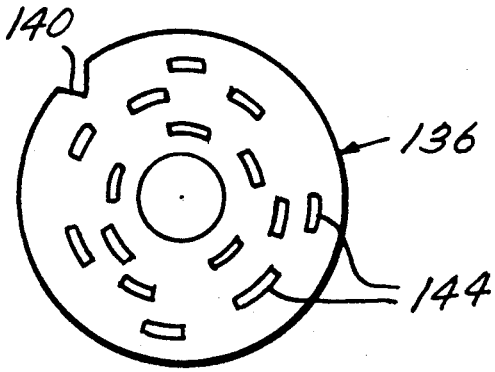
FIG. 12 is a plan view of a typical program disk.
Figure 13:
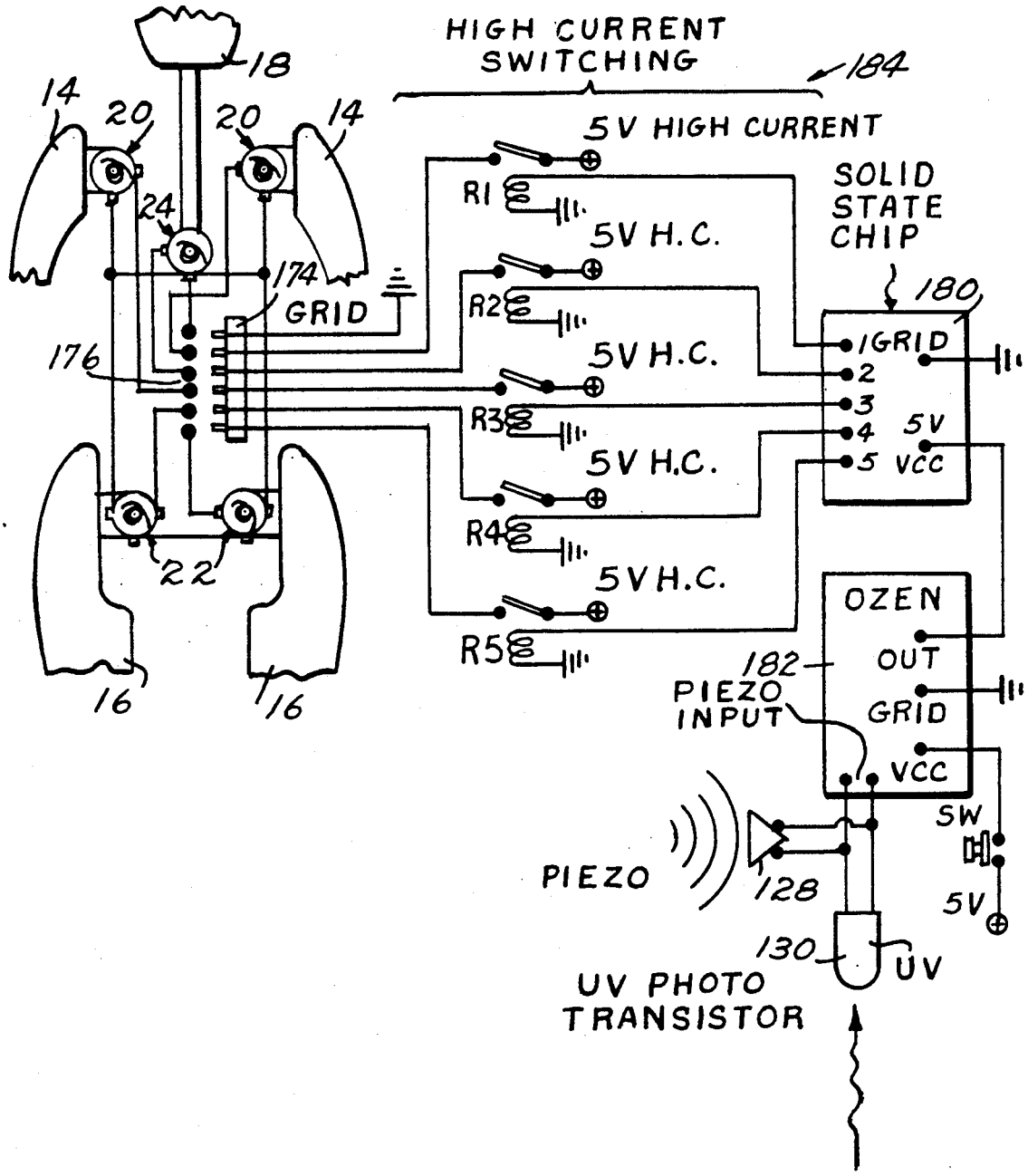
FIG. 13 is a schematic circuit diagram of a variation utilizing a solid state chip.

In another embodiment, as illustrated in FIG. 13, the controller within the base individually controls the actuators by use of solid-state technology. In this embodiment, the same audio and/or infrared or visible light sensing circuitry as used in the embodiment of FIG. 11 may be used to energize a solid-state device, such as a random or programmed output chip 180. The output of the chip would in a random or programmed manner be utilized to individually energize the actuators. Thus, it will be seen that numerous controller means may be interposed between the sensing circuitry of the base 28 and the connector 174 of the stand 30 to effect individual activation of the actuators 20, 22 and 24.

Noting the circuit diagrams, the activation of the device is preferably effected externally utilizing the photo sensor 130 and/or the audio sensor 128 with the received signal closing a switch and triggering an ozen unit 182 which provides a pulse of a predetermined duration, for example seven to fifteen seconds or sufficient time for the stand to make a 360° rotation, while at the same time energizing the actuators through the brush controller means or through relay, i.e. high current switching, means indicated generally at 184, wherein relays R1; R2; R3; R4; and R5 effectively function as would the brush controller means. As noted, rather than relying on the program disks, an appropriate random circuit, utilizing relay means 184 and a random solid-state chip 180, or an equivalent integrated circuit board, not shown, may be provided to selectively and at random intervals provide current, for example 5 volts, to the actuators to produce a random movement of the appendages. Also in lieu of the program disks a programmed chip or "programmed" integrated circuit may be used.

All components of the operating system, including the shafts, flanges and sleeves, other than those within the actuator energizing circuits, are preferably of an appropriate rigid synthetic material such as, but not limited to, high density polyethylene.

I claim:

1. An animated fashion doll adapted to be hand held and including multiple independently articulated appendages, a base, means removably mounting said doll to said base, a separate actuator means in said doll for each appendage, each actuator means being mounted in engagement with its associate appendage for effecting movement of the appendage upon actuation of the actuator means, controller means for controlled activation of said separate actuator means, said controller means including means for independently activating each of said separate actuator means, means for programming the activation of each of said actuator means, said means for programming the activation of said actuator means comprising a replaceable program element in said controller means, said controller means being electrically energizable and sensor means on said controller means responsive to external stimulation for energizing said controller, each of said actuator means being a thermal motor responsive to electrical stimulation from said controller means, each said thermal motor including a thermal member selectively moveable in response to application and removal of heat to and from said thermal member.

2. The animated doll of claim 1 including a fixed position mount for each thermal motor, each thermal motor including shaft means rotatably supported by said mount, said shaft means being fixed to an associated appendage for movement of said appendage, said thermal member including a first end portion fixed relative to said mount and a second end portion, means for engaging said second end portion with said shaft means, said second end portion of said thermal member, upon the heating of the thermal member, moving relative to the fixed first end portion for movement of the engaged shaft means, and the associated appendage fixed thereto, from a first position to a second position, and said thermal motor including memory means for returning said shaft means and associated appendage to said first position upon removal of said heating.

3. The animated doll of claim 2 wherein said shaft means includes a longitudinal axis and is rotatable about said axis, said means for engaging said second end portion with said shaft comprising an abutment fixed to said shaft means eccentric to said axis and engaged by said second end portion.

4. The animated doll of claim 3 wherein said controller means is located within said base, said controller means including an electrically energizable disk, said replaceable program element being juxtaposed said disk and having multiple circular tracks defined thereabout by a series of spaced slots therethrough opening to the juxtaposed disk, multiple electrically conductive brushes overlying said program element, means for effecting relative rotation between said brushes and said program element for selective engagement of the brushes with the disk through said program element slots, and electrical conductor means extending from each of said brushes to a separate one of said actuator means.

5. The animated doll of claim 4 wherein said means mounting said doll to said base includes a vertical stand supported on and extending upwardly from said base, said conductor means extending through said stand, and mating electrical connectors on said stand and said doll for electrically mating said doll to said stand, said connectors being respectively joined to said conductor means of said base and said actuator means within said doll.

6. The animated doll of claim 5 including means mounting said stand for rotation in conjunction with the relative rotation of said brushes and said program element.

7. The animated doll of claim 1 wherein said controller means is located within said base, said controller means including an electrically energizable disk, said replaceable program element being juxtaposed said disk and having multiple circular tracks defined thereabout by series of spaced slots therethrough opening to the juxtaposed disk, multiple electrically conductive brushes overlying said program element, means for effecting relative rotation between said brushes and said program element for selective engagement of the brushes with the disk through said program element slots, and electrical conductor means extending from each of said brushes to a separate one of said actuator means.

8. The animated doll of claim 7 wherein said means mounting said doll to said base includes a vertical stand supported on and extending upwardly from said base, said conductor means extending through said stand, and mating electrical conductors on said stand and said doll for electrically mating said doll to said stand, said connectors being respectively joined to said conductor means of said base and said actuator means within said doll.

9. The animated doll of claim 8 including means mounting said stand for rotation in conjunction with the relative rotation of said brushes and said program element.

10. An animated fashion doll adapted to be hand held and including multiple independently articulated appendages, a base, means removably mounting said doll to said base, a separate actuator means in said doll for each appendage, each actuator means being mounted in engagement with its associate appendage for effecting movement of the appendage upon actuation of the actuator means, and controller means for controlled activation of said separate actuator means, each of said actuator means being a thermal motor responsive to electrical energization from said controller means, said thermal motor including a thermal member selectively moveable in response to application and removal of electrical heating to and from the thermal member.

11. The animated doll of claim 10 including a fixed position mount for each thermal motor, each thermal motor including a shaft movably supported by said mount, said shaft being fixed to an associated appendage for movement of the appendage, a thermal member selectively moveable in response to application and removal of heat to and from said thermal member, said thermal member including a first end portion fixed relative to said mount and a second end portion, means for engaging said second end portion with said shaft, said second end portion of said thermal member, upon the resistance heating of said thermal member, moving relative to said fixed first end portion for movement of the engaged shaft, and the associated appendage fixed thereto, from a first position to a second position, and memory means for returning said shaft and associated appendage to said first position upon removal of said resistance heating.

12. The animated doll of claim 11 wherein said shaft includes a longitudinal axis and is rotatable about said axis, said means for engaging said second end portion with said shaft comprising an abutment fixed to said shaft eccentric to said axis and engaged by said second end portion, said thermal member at least partially encircling said shaft.

13. The animated doll of claim 12 wherein the thermal member and memory means of each said actuator are at least partially coiled about a common longitudinal axis collinear with the longitudinal axis of said shaft means.

14. An animated fashion doll adapted to be hand held and including multiple independently articulated appendages, a separate thermal motor actuator means in said doll for each appendage, each actuator means being mounted in engagement with its associate appendage for effecting movement of the appendage upon actuation of the actuator means, and said thermal motor actuator means being adapted to coact with controller means for controlled activation of said separate actuator means.

15. The animated fashion doll of claim 14 including electrical connector means for electrical connection of said actuator means to the controller means with which they are adapted to coact.

16. The animated fashion doll of claim 14 wherein each of said actuator means being responsive to electrical energization from the controller means with which it is adapted to coact, each said thermal motor actuator means including a thermal member selectively moveable in response to application and removal of heat to and from the thermal member.

17. The animated fashion doll of claim 16 including a fixed position mount for each thermal motor actuator means, each thermal motor actuator means including shaft means rotatably supported by said mount, said shaft means being fixed to an associated appendage for movement of said appendage, said thermal member including a first end portion fixed relative to said mount, and a second end portion, means for engaging said second end portion with said shaft means, said second end portion of said thermal member, upon the heating of the thermal member, moving relative to the fixed first end portion for movement of the engaged shaft means, and the associated appendage fixed thereto, from a first position to a second position, and memory means for returning said shaft means and associated appendage to said first position upon removal of said heating.

18. The animated fashion doll of claim 17 wherein said shaft means includes a longitudinal axis and is rotatable about said axis, said means for engaging said second end portion with said shaft comprising an abutment fixed to said shaft means eccentric to said axis and engaged by said second end portion.

19. The animated fashion doll of claim 14 wherein each of said actuator means is responsive to electrical energization from the controller with which it is adapted to coact, said thermal motor actuator means including a thermal member selectively moveable in response to application and removal of electrical heating to and from the thermal member.

20. The animated fashion doll of claim 19 including a fixed position mount for each thermal motor actuator means, each thermal motor actuator means including a shaft movably supported by said mount, said shaft being fixed to an associated appendage for movement of the appendage, said thermal member including a first end portion fixed relative to said mount, and a second end portion, means for engaging said second end portion with said shaft, said second end portion of said thermal member, upon the resistance heating of the thermal member, moving relative to the fixed first end portion for movement of the engaged shaft, and the associated appendage fixed thereto, from a first position to a second position, and memory means for returning said shaft and associated appendage to said first position upon removal of said resistance heating.

21. The animated fashion doll of claim 20 wherein said shaft includes a longitudinal axis and is rotatable about said axis, said means for engaging said second end portion with said shaft comprising an abutment fixed to said shaft eccentric to said axis and engaged by said second end portion, said thermal member at least partially encircling said shaft.

22. The animated fashion doll of claim 21 wherein the thermal member and memory means of each said actuator means are at least partially coiled about a common longitudinal axis collinear with the longitudinal axis of said shaft.

23. An animated fashion doll adapted to be hand held and including multiple independently articulated appendages, a thermal motor actuator means in said doll for at least one of said appendages, said actuator means being mounted in engagement with its associate appendage for effecting movement of the appendage upon actuation of the actuator means, and said thermal motor actuator means being adapted to coact with controller means for controlled activation of said actuator means.

24. The animated fashion doll of claim 23 wherein a plurality of said articulated appendages are each provided with a separate thermal motor actuator means.

25. The animated fashion doll of claim 24 wherein each of said actuator means being responsive to electrical energization from the controller means with which it is adapted to coact, each said thermal motor including a thermal member selectively moveable in response to application and removal of heat to and from the thermal member.

* * * * *